US005435205A

United States Patent [19]

Seksaria et al.

[11] Patent Number: 5,435,205

[45] Date of Patent: Jul. 25, 1995

[54] PEDAL MECHANISM AND METHOD FOR FORMING THE SAME

[75] Inventors: Dinesh C. Seksaria, Murrysville; Holly J. Crumbly, Pittsburgh, both of Pa.

[73] Assignee: Aluminum Company of America, Pittsburgh, Pa.

[21] Appl. No.: 81,643

[22] Filed: Jun. 24, 1993

[51] Int. Cl.[6] ..... G05G 1/14

[52] U.S. Cl. ..... 74/560; 74/512

[58] Field of Search ..... 74/560, 512, 561, 562, 74/513; 72/60

[56] References Cited

U.S. PATENT DOCUMENTS

| | | | |
|---|---|---|---|
| 3,744,340 | 7/1973 | Peterson | 74/560 |
| 4,356,740 | 11/1982 | Kubo et al. | 74/560 |
| 4,429,899 | 2/1984 | Ohno et al. | 280/689 |
| 4,744,237 | 5/1988 | Cudini | 72/367 |
| 4,829,803 | 5/1989 | Cudini | 72/367 |
| 5,044,223 | 9/1991 | Mizuma et al. | 74/512 |
| 5,070,717 | 12/1991 | Boyd et al. | 72/55 |
| 5,078,024 | 1/1992 | Cicotte et al. | 74/512 |
| 5,188,001 | 2/1993 | Sukeshita et al. | 74/513 X |

FOREIGN PATENT DOCUMENTS

| | | | |
|---|---|---|---|
| 2506971 | 12/1982 | France | 74/560 |
| 2523742 | 9/1983 | France | 74/560 |
| 3427097 | 1/1986 | Germany | 74/560 |
| 2-29812 | 1/1990 | Japan | 74/560 |
| 2034010 | 5/1980 | United Kingdom | 74/560 |
| 80/00278 | 5/1981 | WIPO | 74/560 |

*Primary Examiner*—Vinh T. Luong
*Attorney, Agent, or Firm*—Suzanne Kikel; Thomas R. Trempus

[57] ABSTRACT

A pedal for a vehicle has an integrally formed clevis, a central portion, and an integrally formed relatively flat foot engaging section. A lightweight, one-piece, extruded aluminum tubing with a thin wall and a round cross section is bent at an acute angle to form a clevis at its upper end and is bent at about a right angle at its lower end to form a foot engaging portion. A hydroforming process forms the walls of the clevis end and the central portion into a rectangular cross section and forces the walls of the lower end together to form a relatively flat, smooth, upper foot engaging surface and an undersurface with longitudinal ribs. Hexagonally configured apertures in opposing walls of the clevis receive a bushing having the same hexagonal configuration. A cut-out section communicates with the aperture in the two opposing walls, and the bushing is secured in the apertures by forcing together the walls adjacent to those with the apertures to close the gap in the cut-out sections. This action causes the walls of the apertures to be received in notches provided in the bushing.

12 Claims, 3 Drawing Sheets

PEDAL MECHANISM AND METHOD FOR FORMING THE SAME

BACKGROUND OF THE INVENTION

1. Field of the Invention

The invention relates to a control pedal for a vehicle, and more particularly, to its construction and a method of forming the same.

2. Description Of the Prior Art

Conventional motor vehicles have pedals for operating the motor vehicle brake, the clutch, the accelerator, and the parking brake. Usually, such pedals include a lever pivoted at one end to the vehicle body, a pedal plate at the other end to which the operator applies force, and a pivot intermediate the pedal ends for attachment of the actuating push rod or a cable for the motor vehicle brake, the clutch, the accelerator, or the parking brake. Most of these pedal constructions are fabricated assemblies and made of steel. These pedals typically consist of a bent steel bar with apertures and bushings at one end for receiving an axle pin for its pivotal attachment to the vehicle and a stamped sheet metal foot pad at the other end. The foot pedal, the bushing, and the bracketry are welded to the bent steel bar to make the pedal assembly. This typical pedal assembly may also have fabricated tabs welded to it for the actuation of switches, the attachment of return springs, etc. These prior constructions for present-day pedals are relatively heavy and expensive to manufacture.

U.S. Pat. No. 3,744,340 discloses a one-piece stamped brake pedal having a tubular member, an integrally stamped pedal pad at one end of the tubular member, an integrally stamped clevis at the other end of the tubular member, and a pivot in the tubular member intermediate the pedal pad and the clevis for attachment of the brake actuating push rod. This construction involves interlocking tabs formed along the edges of the sheet metal blank which eliminate the need for a welding or a similar joining operation.

Other examples of a pedal apparatus are disclosed in U.S. Pat. Nos. 4,356,740, 5,044,223, and 5,078,024.

It is desirable from the standpoint of manufacturing economy as well as quality control that such a pedal for a motor vehicle brake, a clutch, an accelerator, or a parking brake be of lightweight construction requiring no welding or equivalent joining operation.

There also remains a need for a pedal which facilitates the safe operation of the vehicle, is highly durable and reliable, and meets all performance expectations for the vehicle.

SUMMARY OF THE INVENTION

The present invention has met the above-described needs. A pedal mechanism of the present invention is lightweight, easy to manufacture and construct, and requires no welding or thermal type of joining operation.

The pedal mechanism consists of an upper clevis portion, a central portion, and a lower foot engaging section. The pedal mechanism is made from a single length of extruded, thin walled, round cross-section, aluminum tubing.

One end of the tubing is slightly bent relative to its longitudinal length, and the other end is bent at about a right angle relative to its longitudinal length to extend in a plane perpendicular to that of the one end to form an integral foot engaging section. The diametrically opposite walls of the slightly bent one end and the central section of the tubing are formed, preferably, into a rectangular cross section, and the walls of the angled portion on the foot engaging section are forced substantially together to form a flat, smooth top surface and an undersurface with longitudinal ribs. The ribs provide the required rigidity for the foot engaging section in a minimum amount of space.

A clevis is formed in the slightly bent portion by providing an aperture in each of two opposing walls and a cut-out section in communication with each aperture. A bushing is provided in the apertures and extends transversely across and in the slightly bent portion in the same direction in which the foot engaging section extends.

The bushing is secured in the apertures by forcing together the two opposing walls adjacent to those containing the apertures. This action causes the gap in the cut-out sections in communication with the apertures to close. The bushing is shaped such that it has several flat adjacent sides which correspond to the configuration of the sidewalls of the apertures. The configuration of the sidewalls of the bushing and the sidewalls of the aperture which, preferably, is hexagonal in cross section, prevents rotation of the bushing within the apertures. Preferably, a notch is provided near each end of the bushing along one of its flat surfaces. When the walls of the slightly bent end are forced together for securement of the bushing in the apertures, each notch is caused to engage a flat sidewall of its respective aperture, thereby resisting movement of the bushing in a transverse, axial direction.

The bushing receives a bolt or a pin for pivotal attachment of the pedal mechanism to the body of a vehicle.

A hole is provided in the walls of the slightly bent portion to allow the attachment of a return spring which returns the pedal mechanism to its original positioning when it is released from its depressed positioning.

It is, therefore, an object of the present invention to provide a pedal for a motor vehicle brake, a clutch, an accelerator, or a parking brake for a vehicle which is relatively lighter in weight than presently available pedals, and yet, inexpensive to manufacture and still be of the highest durability and reliability, and completely meeting the performance and vehicle safety standards.

It is a further object of the present invention to provide a pedal and an associated method for forming a pedal with an integrally formed clevis at one end and an integrally formed foot engaging portion at the other end.

It is a further object of the present invention to provide a pedal mechanism whose main components are integrally formed, thereby eliminating the need for any joining operations, such as welding.

It is a further object of the present invention to provide a pedal mechanism having a limited number of components for its attachment to a vehicle body.

It is a further object of the present invention to provide a pedal mechanism which is manufactured by a hydroforming process or a similar manufacturing process.

It is still a further object of the present invention to provide a pedal mechanism characterized as having optimal structural performance for the applied loads and an adequate contact surface area for the actuation of a switch upon pivotal movement thereof.

It is still a further object of the present invention to provide a stiff pedal mechanism which can effect a surer feel for the vehicle operator.

These and other objects of the invention will be more fully understood from the following description of the invention with reference to the drawings.

DETAILED DESCRIPTION OF A PREFERRED EMBODIMENT

Figure 1:
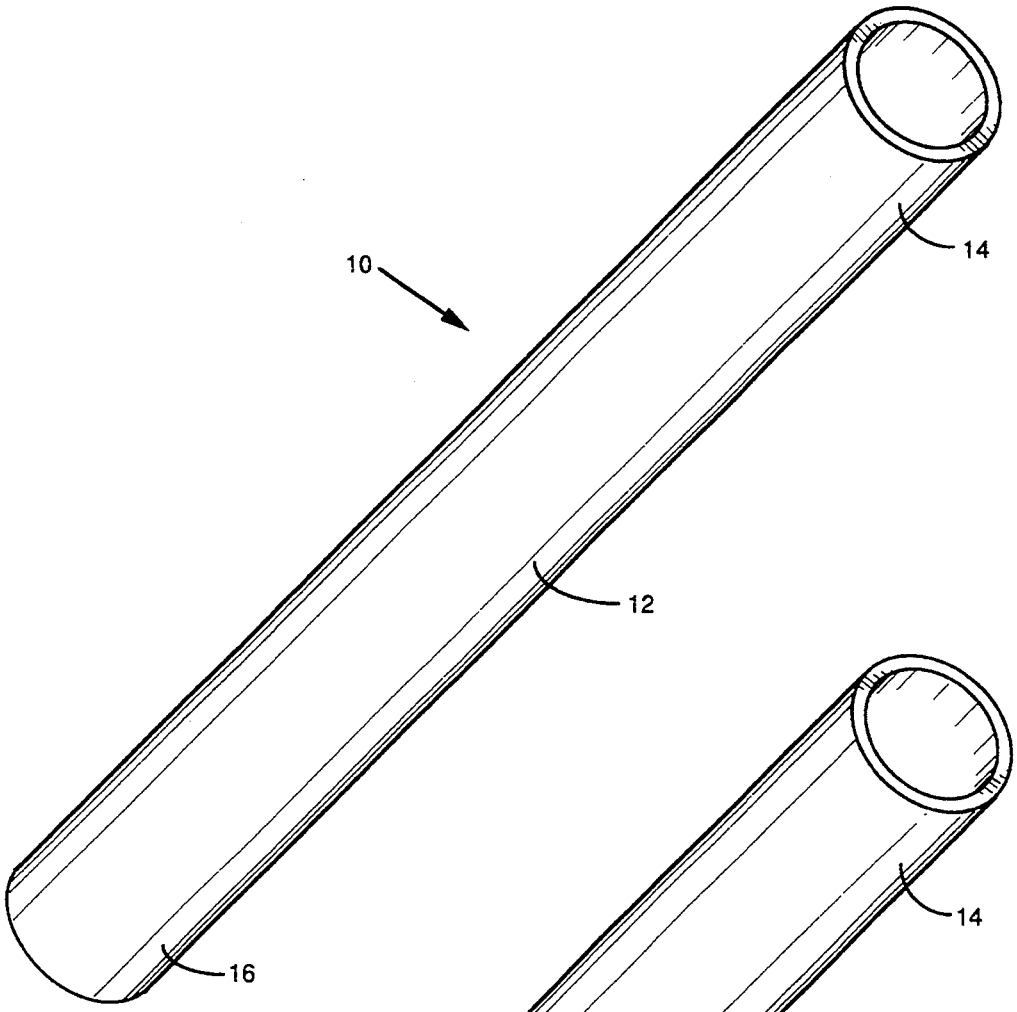
FIG. 1 is a perspective view showing a single length of extruded tubing prior to its being formed into a pedal mechanism of the present invention.
Figure 2:
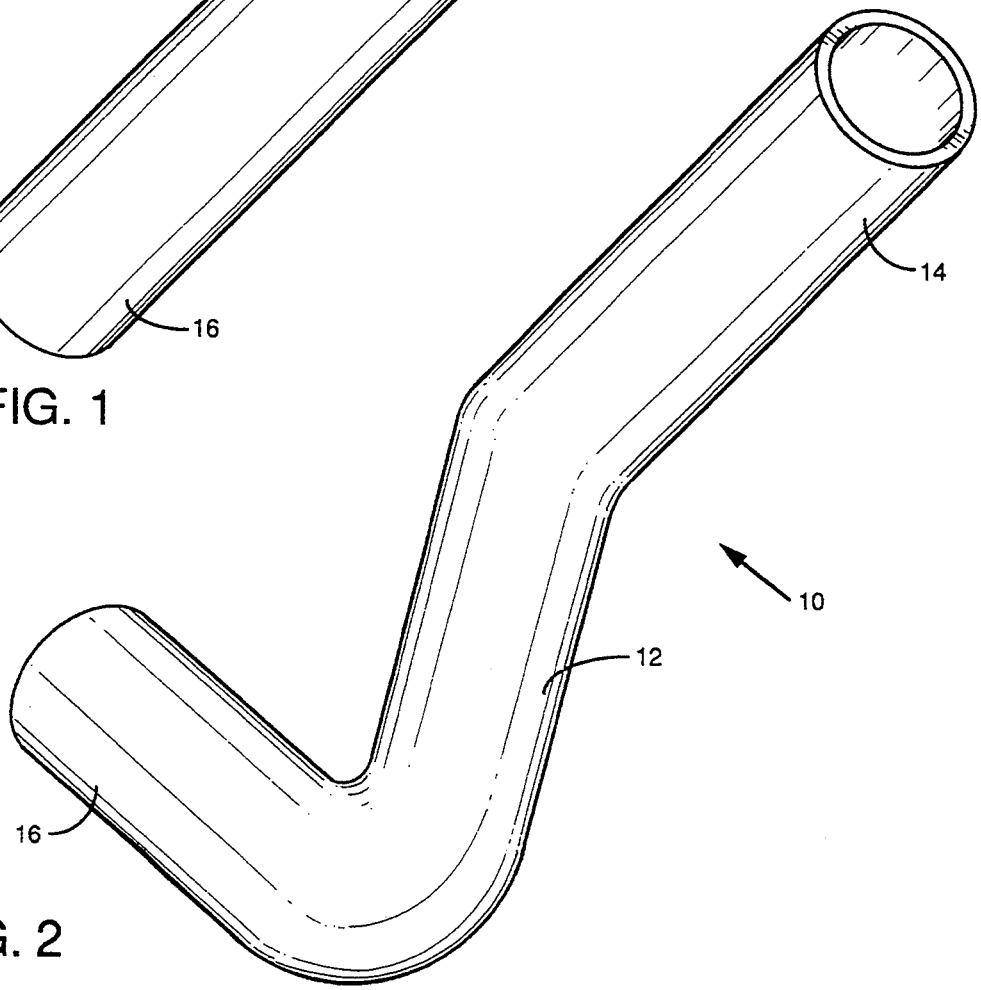
FIG. 2 is a perspective view of the tubing of FIG. 1 after it has undergone a few steps in the forming of a pedal mechanism according to the teachings of the present invention.
Figure 3:
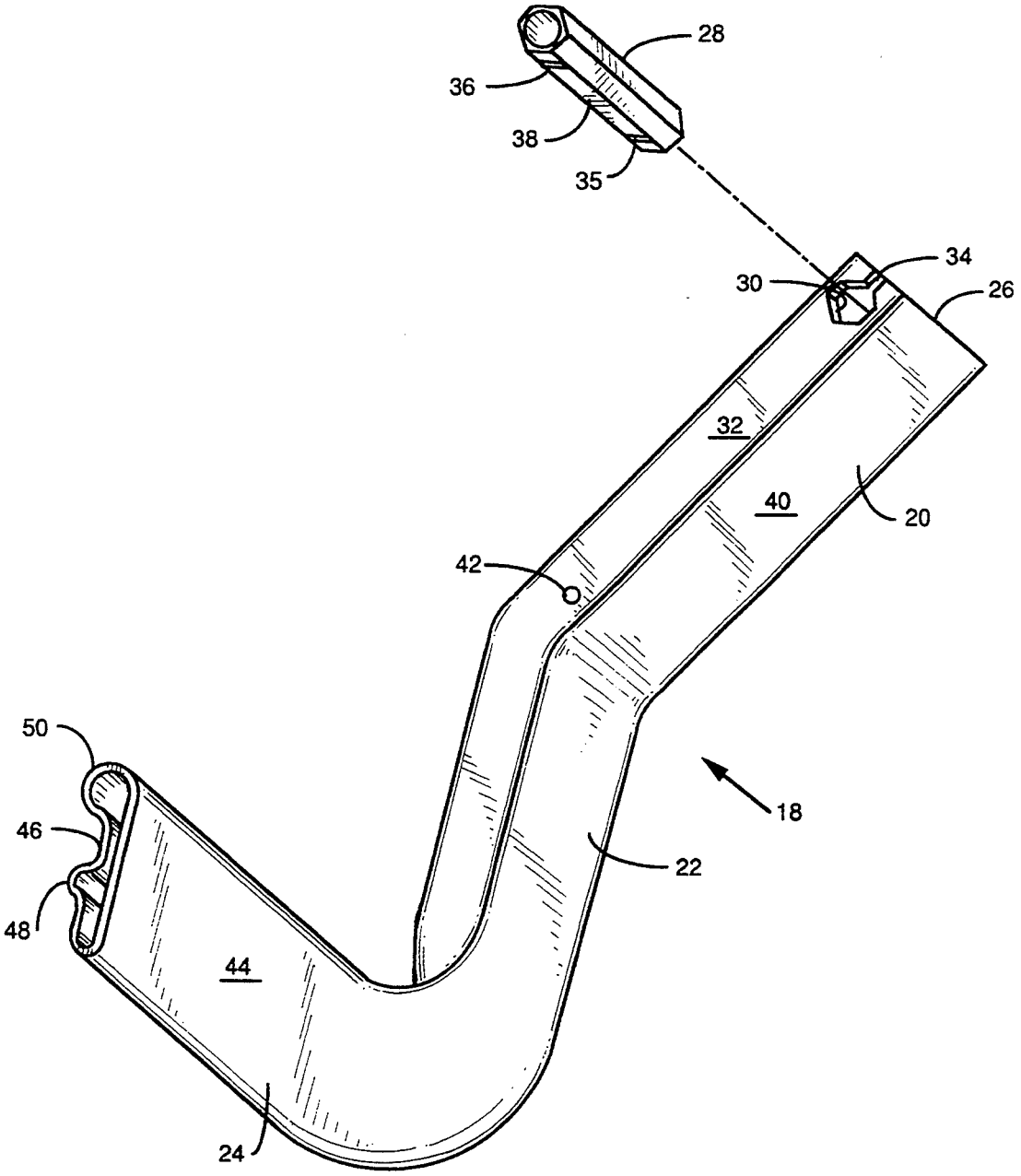
FIG. 3 is a perspective, exploded front view illustrating a pedal mechanism of the present invention after it has been formed.
Figure 4:
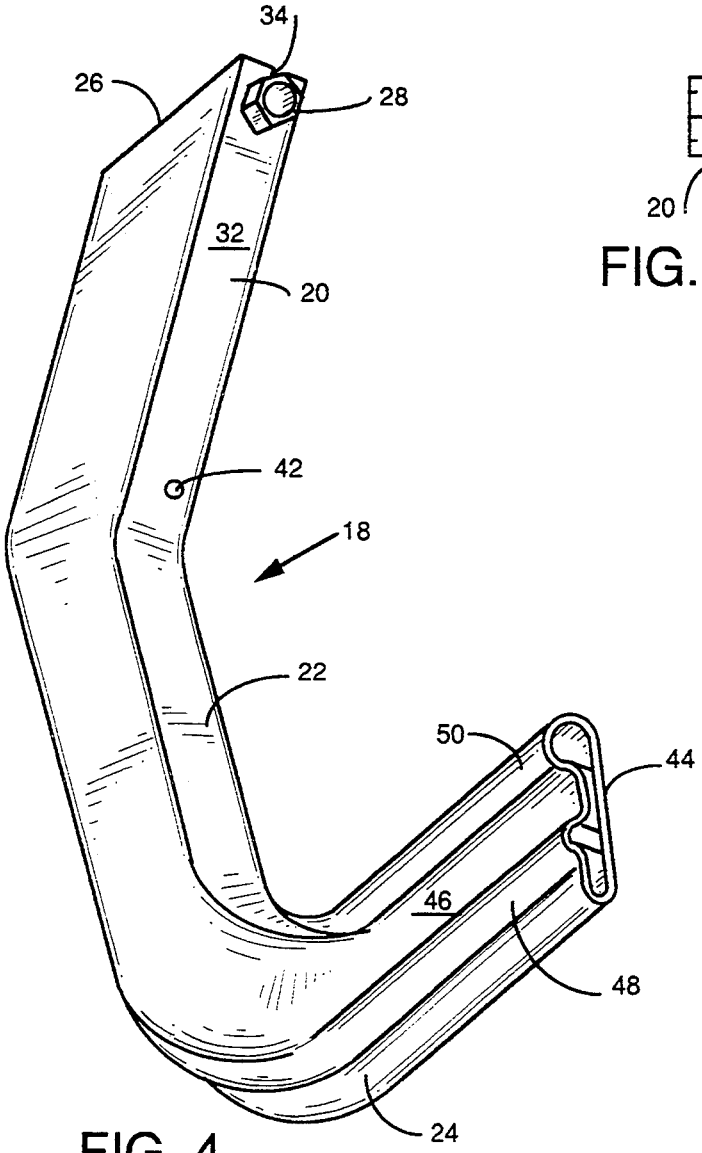
FIG. 4 is a perspective rear view of the pedal mechanism formed according to the teachings of the present invention.
Figure 5:
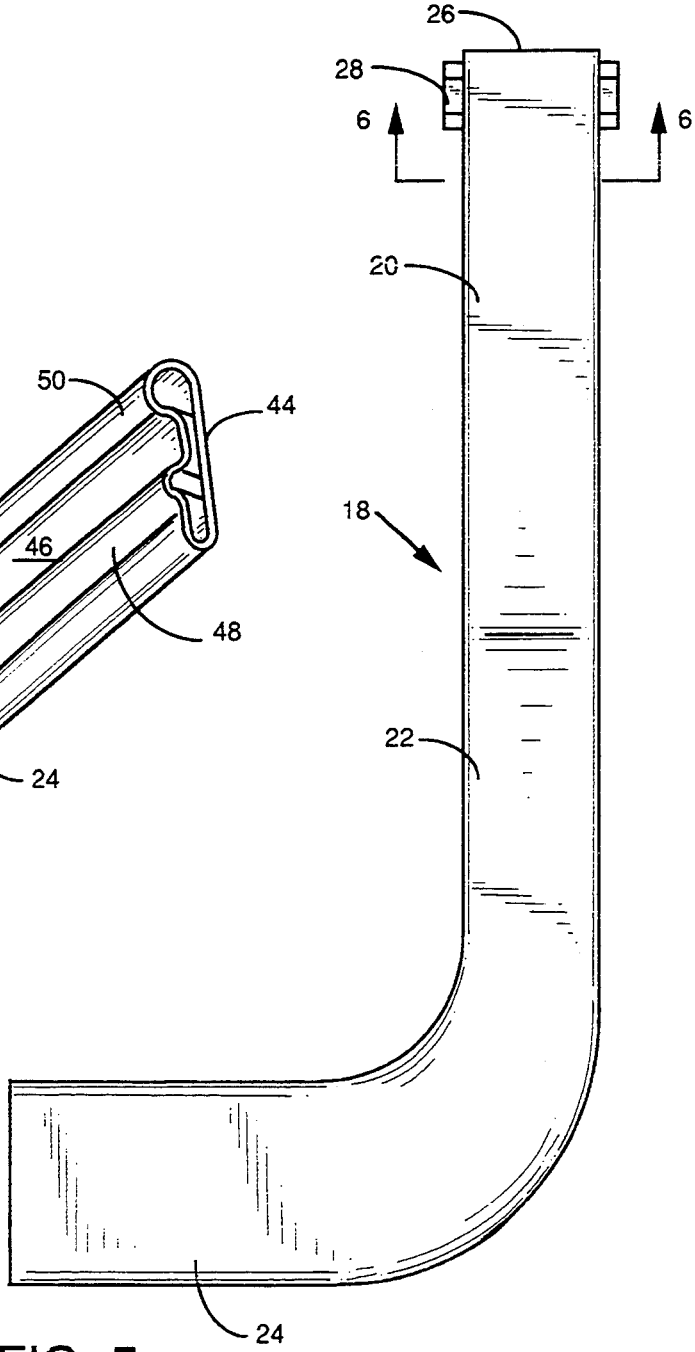
FIG. 5 is a front elevational view of a pedal mechanism formed according to the teachings of the present invention.

FIGS. 1 and 2 particularly show the several steps involved in forming the pedal mechanism of the present invention, and FIGS. 3–5 show the finished product.

The pedal mechanism of the invention is made from a tubing similar to that shown in FIG. 1. FIG. 1 shows a single length of straight, extruded lightweight, metal tubing 10 with a generally round cross section and a thin wall. Tubing 10 has a body portion 12, an upper portion 14, and a lower portion 16. Tubing 10 is preferably about 20 inches to about 24 inches in length, and preferably, is made of aluminum, such as 6000 Series, T-4 Temper. Other metals, such as steel could be used, but generally, aluminum with 6XXX series is used. Preferably, tubing 10 has an inner diameter of about 1.50 inches to about 1.75 inches, and the outer diameter may range from about 1.625 inches to about 2.00 inches. The wall thickness of tubing 10 may range from about 0.06 to about 0.120 inch and preferably is 0.10 inch.

FIG. 2 shows a subsequent step in forming the pedal mechanism of the present invention. Upper portion 14 is slightly bent at about an acute angle relative to the length of main body portion 12, and lower portion 16 is bent in a plane different than that of upper portion 14 at about a right angle relative to the length of main body portion 12. The upper portion 14 in its bent form of FIG. 2 may preferably be about 6 inches long, and lower portion 16 in its bent form of FIG. 2 may preferably be about 10 inches to 12 inches long. The angle for upper portion 14 may be about 20 to 40 degrees and is preferably about 25 to 30 degrees. The angle for lower portion 16 may be about 80 to 100 degrees and is preferably about 85 to 95 degrees. The planes in which upper portion 14, main body portion 12, and lower portion 16 extend are, for example, as follows: With reference to a Cartesian coordinate system, if the length of main body 12 can be considered to represent a Y-axis, then upper portion 14 is bent to extend in an X-Y plane, and lower portion 16 is bent to extend outwardly in an X-Z plane.

FIG. 3 illustrates the finished product for a pedal mechanism 18. In order to produce the pedal mechanism 18 of FIG. 3, the tubing 10 of FIG. 2 is subjected preferably to a hydroforming process.

Figure 6:
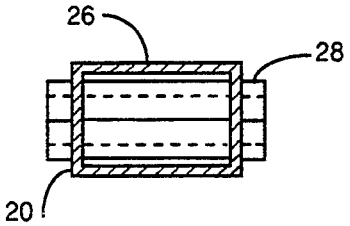
FIG. 6 is a cross-sectional view taken along lines 6—6 of FIG. 5.

A hydroforming process is a manufacturing process which is well known to those skilled in the art which deforms by dies a tubing into a desired configuration. Such process is disclosed in U.S. Pat. Nos. 4,744,237, 4,829,803, and 5,070,717 which are incorporated herein by reference. In general, this deformation process is caused by applying hydraulic pressure to the inside of a tubing to deform the walls of the tubing outwardly between the mating surfaces of die sections causing the tubing to take on the same configuration as that of the dies. For the tubing 10 of the present invention, the walls of central portion 12 and upper portion 14 of tubing 10 of FIG. 2 are formed into a substantial rectangular cross-section area indicated in FIG. 3 and in FIG. 6 at numerals 20 and 22, respectively. As shown in FIG. 3, the rectangular cross section of central portion 22 is carried substantially through its length until just before the bend which forms the right angle foot engaging section 24, where the walls of the lower portion 16 of FIG. 2 are substantially compressed together, more about which will be discussed hereinbelow. It is to be appreciated that while the preferred embodiment as described and illustrated herein incorporates a rectangular cross section, load and packaging requirements encountered in the utilization of this pedal mechanism may be satisfied by modifications to this cross-sectional configuration.

Referring to the upper right-hand section of FIG. 3, upper end 20 of pedal mechanism 18 has a clevis section 26. Clevis section 26 has opposed apertures for receiving a bushing 28. One such aperture is shown at 30 in sidewall 32. Directly above aperture 30 is a cut-out section 34 which is in communication with the extreme end of sidewall 32 and with aperture 30 in sidewall 32. It is to be appreciated that the sidewall parallel and directly opposed to sidewall 32 has an aperture and cut-out section similar to that in sidewall 32.

The inner walls of the two opposed apertures in clevis section 26, preferably, form a hexagonal shape which corresponds to the outer wall configuration of bushing 28. The configuration of the inner walls of the apertures and the configuration of the outer walls of the bushing may both be pentagonal, rectangular, or octagonal, the important thing being that these configurations for the bushings 28 and apertures consist of several adjacent flat surfaces in order to prevent rotation of bushing 28 in the apertures of clevis section 26.

As particularly shown in FIG. 3, bushing 28 has grooves or notches 35 and 36 in flat outer surface 38. In order to lock bushing 28 in clevis section 26, the opposing walls, one of which is indicated at number 40, adjacent to the walls 32 containing the apertures, are forced together to narrow or close the gap of the cut-out sections in communication with the apertures. The forcing of wall 40 and its opposing wall together prevents bushing 28 from moving out of clevis section 26 in a radial direction. In the action of forcing wall 40 and its opposing wall together, a flat inner wall of each aperture is received in an adjacent groove 35, 36 in flat surface 38 of bushing 28. This prevents bushing 28 from moving in an axial transverse direction in clevis section 26.

Bushing 28 is used to receive a pivot pin or axle (not shown) which, as known to those skilled in the art, is pivotally connected to the vehicle for support thereby. An axle pin may be passed through a bracket (not shown) which is fixed to the vehicle body in a manner discussed in U.S. Pat. No. 4,356,740, which is incorporated herein by reference.

Also, as disclosed in the aforesaid U.S. Pat. No. 4,356,740, a return spring (not shown) which is used to return the pedal to its initial non-depressed position, may be wound around the axle pin secured in bushing 28. Still referring to FIG. 3, aperture 42 is provided in sidewall 32 of clevis section 26 of pedal mechanism 18 and can be used for attaching one end of the return spring to pedal mechanism 18. The other end of the return spring may be engaged to the bracket discussed herein before. This attachment of the ends of the return spring to the bracket and pedal mechanism 18 allows the operator of the vehicle to urge the pedal mechanism 18 away from him and to retain the mechanism 18 at a predetermined position, such as an idling position as disclosed in the aforesaid U.S. Pat. No. 4,356,740. A tension spring may also be used where its one end would be secured in aperture 42. A torsion spring may also be employed in a similar function. Aperture 42 is shown as being in sidewall 32, but it is to be appreciated that it can be formed in any of the sidewalls of pedal mechanism 18.

Referring to FIGS. 2, 3, 4, and 5, as discussed hereinabove, the lower portion 16 of FIG. 2 is formed into a relatively flat section as shown in FIGS. 3, 4, and 5, where the diametrically opposed walls of tubing 10 are forced together. As shown in FIGS. 3 and 4, foot engaging section 24 preferably, has an arched, upper surface 44 and an undersurface 46 with ribs 48 and 50 which extend longitudinally along the length of foot engaging section 24. Ribs 48 and 50 are, preferably, made during the hydroforming process. Ribs 48 and 50 provide the required rigidity for the foot engaging pedal portion 24 in a minimal amount of space. While the arched, upper surface 44 is shown to be relatively smooth, alternatively, the upper surface 44 can be formed to include ridges or like means that frictionally engage bottom of the operator's footwear and provide surer feel to the operator of the vehicle. Optionally, a rubber pad (not shown) may be slid onto pedal portion 24 for a more comfortable and surer feel for the operator.

The dimensions for the finished product for pedal mechanism 18 of FIGS. 3, 4, and 5 depend on those of tubing 10 of FIG. 2. The dimensions will be tailored to optimize the structural performance of the pedal mechanism 18 for the applied loads, which loads are transferred into the body of the pedal mechanism 18 upon its operation. In certain applications, the pedal mechanism 18 may be used in conjunction with an actuating switch. The rectangular surface area of section 20 and central section 22 (as illustrated in FIG. 5 and in FIG. 6) provide an adequate contact surface for the depression of a switch such as a brake light switch for its operation.

The pedal mechanism 18 of FIGS. 3, 4, and 5 is made from a thin walled, aluminum extruded tubing with no welded parts. This results in a pedal mechanism which is considerably lighter than present-day pedal mechanisms, and typically, can be as much as 60% lighter than these present-day pedal mechanisms.

When the pedal mechanism 18 of the present invention is installed, preferably, it will be positioned similar to that shown in FIG. 5 such that upper portion 20 will be facing the operator of the vehicle; central portion 22 will extend outwardly toward the operator; and foot engaging section 24 will extend perpendicularly to the left with respect to central portion 22. For certain applications, foot engaging section 24 can be made to bend and extend perpendicularly to the right with respect to central portion 22.

Even though a hydroforming process has been described for forming the finished product of FIGS. 3, 4, and 5, it is to be appreciated that similar manufacturing processes can be employed in order to reduce and keep manufacturing costs at a minimum. Also, even though upper portion 20 and central portion 22 of the pedal mechanism 18 are formed into a rectangular cross section, they can be formed into other types of cross sections, such as an I-beam or a square.

Whereas a particular embodiment of the invention has been described above for purposes of illustration, it will be evident to those skilled in the art that numerous variations of the details may be made without departing from the invention as defined in the appended claims.

What is claimed is:

1. A pedal mechanism comprising:

a one-piece extruded metal tubular member having a first end and a second end with a free end, and a center section between said first end and said free end of said second end, and including a clevis portion formed within said first end of said extruded metal tubular member and a foot engaging portion formed within said free end of said second end of said extruded tubular member, said clevis portion consisting of spaced-apart wails, which are rectangular in cross-section, aperture means in at least two opposed said spaced-apart walls, cut-out section means in communication with said aperture means, and bushing means supported in said aperture means.

2. A pedal mechanism of claim 1 wherein said metal is aluminum.

3. A pedal mechanism of claim 1 wherein said foot engaging portion includes collapsed spaced-apart wall portions with a planar upper surface and a ribbed undersurface.

4. A pedal mechanism of claim 1 wherein said bushing means consists of an outer surface and notch means formed in said outer surface, and wherein said aperture means consists of inner surface means which are received in said notch means of said bushing means for securement of said bushing means in said aperture means.

5. A pedal mechanism of claim 1 wherein said aperture means consists of at least one flat inner surface and said bushing means consists of at least one flat outer surface, and wherein the configuration of said outer surface of said bushing means corresponds to the configuration of said inner surface of said aperture means.

6. A pedal mechanism of claim 1, wherein said bushing means consists of several adjacent outer surfaces and said aperture means consists of several adjacent inner surfaces and wherein the configuration of said outer surfaces of said bushing means and the configuration of said inner surfaces of said aperture means are hexagonal.

7. A pedal mechanism of claim 1 wherein said wall of said tubular member is about 0.06 inch to about 1.20 inch.

8. A pedal mechanism of claim 1 wherein said pedal mechanism is a vehicle pedal.

9. A pedal mechanism of claim 1 wherein said center section, said clevis portion and said foot engaging portion are angularly offset with respect to each other.

10. A pedal mechanism, comprising:

a one piece, extruded metal tubing member having an integrally formed clevis means disposed at a first end of said member, an integrally formed foot engaging means disposed at a second end of said member having a free end, and an integrally formed central section disposed between said first end and said free end of said second end of said extruded metal tubing member, said clevis means comprising aperture means and cut-out section means in communication with said aperture means, and bushing means supported in said aperture means, and said bushing means comprising outer surface means and notch means formed in said outer surface means, and said aperture means comprising inner surface means which are, received in said notch means of said outer surface means of said bushing means for securement of said bushing means in said aperture means.

11. A pedal mechanism of claim 10 wherein said aperture means further consists of at least one inner surface for supporting said inner surface means of said aperture means and said outer surface means of said bushing means consists of at least one outer surface, and wherein the configuration of said outer surface of said bushing means corresponds to the configuration of said inner surface of said aperture means.

12. A pedal mechanism of claim 10 wherein said outer surface means of said bushing means consists of several adjacent outer surfaces, one of which said outer surfaces supports said notch means of said bushing means, and said aperture means further consists of several adjacent inner surfaces, one of which said inner surfaces supports said inner surface means of said aperture means, and wherein the configuration of said outer surfaces of said bushing means and the configuration of said inner surfaces of said aperture means are hexagonal.

* * * * *

UNITED STATES PATENT AND TRADEMARK OFFICE

CERTIFICATE OF CORRECTION

PATENT NO. : 5,435,205

DATED : July 25, 1995

INVENTOR(S) : Dinesh C. Seksaria et al.

It is certified that error appears in the above-indentified patent and that said Letters Patent is hereby corrected as shown below:

| | |
|---|---|
| Col. 6, line 32, Claim 1 | After extruded, insert -- metal--. |
| Col. 6, line 54, Claim 5 | Before inner, delete "flat". |
| Col. 6, line 55, Claim 5 | Before outer, delete "flat". |

Signed and Sealed this

Third Day of March, 1998

*Attest:*

*Attesting Officer*

BRUCE LEHMAN

*Commissioner of Patents and Trademarks*